United States Patent [19]

Allen et al.

[11] Patent Number: 4,651,806

[45] Date of Patent: Mar. 24, 1987

[54] HEAT EXCHANGER WITH ELECTROHYDRODYNAMIC EFFECT

[75] Inventors: Peter H. G. Allen; Paul Cooper, both of London, England

[73] Assignee: National Research Development Corporation, London, England

[21] Appl. No.: 777,456

[22] Filed: Sep. 18, 1985

[30] Foreign Application Priority Data

Sep. 24, 1984 [GB] United Kingdom ..... 8424061

[51] Int. Cl.[4] ..... F28F 13/16

[52] U.S. Cl. ..... 165/1; 165/96; 165/110

[58] Field of Search ..... 165/1, 2, 96, 110, 109.1, 165/134.1

[56] References Cited

U.S. PATENT DOCUMENTS

| | | | |
|---|---|---|---|
| 1,835,557 | 12/1931 | Burke | 165/1 X |
| 3,056,587 | 10/1962 | Steigerwald | 165/1 |
| 3,370,644 | 2/1968 | Daily et al. | 165/1 |
| 3,526,268 | 9/1970 | Robinson | 165/1 |
| 3,794,111 | 2/1974 | Blomgren, Sr. et al. | 165/1 |
| 3,872,917 | 3/1975 | Blomgren, Sr. et al. | 165/110 X |
| 4,056,142 | 11/1977 | Baumann et al. | 165/133 |
| 4,471,833 | 9/1984 | Yabe et al. | 165/1 |
| 4,548,262 | 10/1985 | Hull | 165/109.1 X |

FOREIGN PATENT DOCUMENTS

| | | |
|---|---|---|
| 0069989 | 1/1983 | European Pat. Off. . |
| 2259348 | 12/1972 | Fed. Rep. of Germany . |
| 85468 | 7/1965 | France . |
| 100796 | 6/1916 | United Kingdom . |
| 741126 | 11/1955 | United Kingdom . |
| 932955 | 7/1963 | United Kingdom . |

OTHER PUBLICATIONS

Effect of Electric Field on Boiling Hysteresis in Carbon Tetrachloride by D. K. Basu; pp. 1322–1324, Int. J. Heat Mass Transfer, vol. 16, 5/1973.

Pat. Abstracts of Japan, vol. 8, No. 263 (M-342) [1700], Dec. 4th, 1984; JP-A-59 134 495 (Kogyo Gijutsuin) 02-08-1984.

*Primary Examiner*—Albert W. Davis, Jr.
*Assistant Examiner*—Randolph A. Smith
*Attorney, Agent, or Firm*—Cushman, Darby & Cushman

[57] ABSTRACT

A heat exchanger comprising a casing through which pass a plurality of spaced-apart tubes. Heat exchange takes place through the tube walls between a first fluid within the tubes and a second fluid outside them but within the casing. The rate of heat exchange is enhanced by electrohydrodynamic effect by means of an electrode comprising a sheet-form first part which encompasses the tubes, and connected second parts which run lengthwise through the spaces between the tubes. The first part may be mesh-like and the second parts may be mesh-like and/or rod-like. The electrode is excited to high voltage and the casing and tubes are grounded. The effect of the second parts is to make the electric field around the individual tubes more uniform than would be the case if the electrode consisted of the first part alone.

5 Claims, 4 Drawing Figures

HEAT EXCHANGER WITH ELECTROHYDRODYNAMIC EFFECT

This invention relates to heat exchangers, especially those of the so-called "shell-tube" type in which an arrangement of a plurality of spaced-apart tubes passes through a shell or casing. While it is well known to use such apparatus as an evaporator, and the present invention includes evaporation processes and apparatus to effect them, it is equally well known to use such apparatus to effect condensation and the present invention will be described primarily with reference to that process.

Such an arrangement of tube within a shell or casing will henceforth be referred to in general, in this specification, as a "pass" of tubes. It is well known for the casing to be cylindrical, for the axes of all the tubes within the pass to be parallel to the casing axis, and for the tubes to be so disposed that when viewed in transverse section they lie at the vertices or intersections of a grid or other regular pattern. It is also well known for the tubes of such a pass to enter the casing at one end and leave it at the other. However passes of tubes conforming to other patterns are also possible, and this invention applies to them also. For example the tubes need not all be parallel to each other: while all following the same general lengthwise path, they might be randomly aligned. As another example, the disposition of the tubes could follow a regular pattern but the entire pass could include several groups of tubes, those within each group being parallel to each other but those of one group being angled relative to those of another. Passes can also comprise angled and curved tubes rather than straight ones, and in particular passes are possible in which generally "U"-shaped tubes enter and leave a casing through relatively-adjacent parts of the casing wall, instead of entering through one end of the casing and leaving through an opposite end.

The shell of a shell-tube heat exchanger typically has at least one inlet through which a first fluid medium enters the shell, and at least one outlet through which that medium leaves the shell after a phase change, and the tubes of the pass are in circuit with a pump that drives a second fluid medium through them. When the apparatus is used as a condenser, the first fluid medium enters the shell as a gas and leaves as a liquid, after exchange of heat with a relatively cold second medium through the walls of the tubes.

It has been known generally, for about fifty years at least, that electric fields can have an effect upon heat transfer. More specifically, it has been known for about twenty years that the rate at which liquid at one temperature vaporises when in contact with a surface at a higher temperature can be enhanced by locating that surface within the electric field generated by an electrode, insulated from the surface and connected to a source of high voltage. Dispite the knowledge of these effects, to which the general description electrohydrodynamic or EHD has been applied, we are unaware that any substantial commercial use has been made of them, for example in shell-tube heat exchangers. The object of the present invention is to put EHD effects to such a use, and according to the invention a heat exchanger comprises a pass of tubes arranged within a shell-type casing so that heat exchange takes place through the tube walls between a first fluid medium within the tubes and a second medium outside them but within the shell, and means to enhance the rate of heat exchange by electrohydrodynamic effect, these means comprising an electrode located within the shell but insulated from both shell and tubes and capable of being excited to high voltage, in which the electrode comprises a substantially sheet-form first member which encompasses the pass and is electrically connected to second members running lengthwise through the pass. The tubes may all lie parallel to each other and may be so arranged that when viewed in transverse section they lie at the vertices or intersections of a grid or other regular pattern. The first member of the electrode may be of mesh or other open-work form.

The electrode may comprise end frames, between which both the first and second members are supported, and the end frames may each comprise an outer boundary spanned by members arranged in grid-like formation, the first member of the electrode being attached to the outer boundary, the ends of the second members being supported on the members of the grid, and the tubes of the pass passing through the voids of the grid. The second members of the electrode may include at least one sheet-form member of mesh or other open-work form, or rod-like structures, or both.

The invention also includes a method of heat exchange between the first and second fluid media, using apparatus as just defined, in which the rate of heat exchange is enhanced by exciting the electrode to high voltage and so creating high electric fields around each of the tubes, and in which an effect of the second members is to make the field around each tube more uniform than would be the case if the electrode consisted of the first member alone.

The invention will now be described, by way of example, with reference to the accompanying drawing in which.

Figure 1:
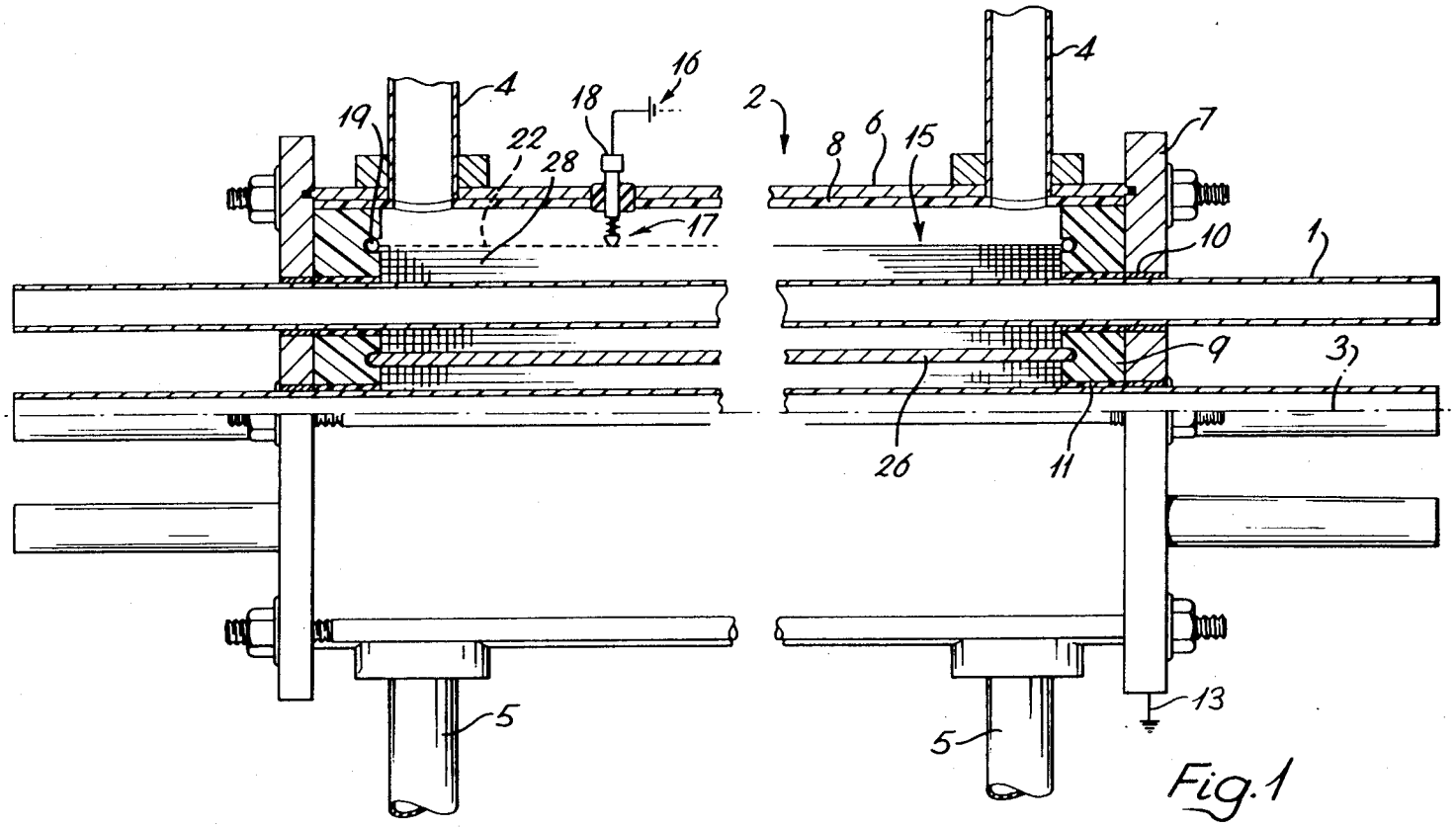
FIG. 1 is an axial section through a shell-tube heat exchanger.
Figure 2:
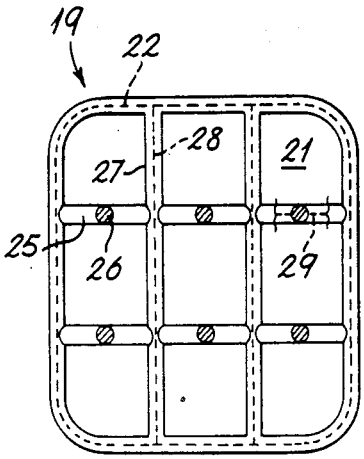
FIG. 2 is an elevation of the electrode, taken in an axial direction.

The illustrated apparatus includes a pass of tubes comprising nine brass heat-exchange tubes 1, spaced-apart and with their axes parallel in a regular 3×3 grid formation within a cylindrical steel shell 2, the axis of the shell coinciding with the axis of the central tube. As shown the axes of the tubes 1 and shell 2 are horizontal but the invention applies equally to a vertical or other alignment. As FIG. 1 shows, the shell 2 has two inlets 4 through which gaseous fluid to be condensed may enter, and a further two outlets 5 through which the resulting condensed liquid may leave.

Figure 3:
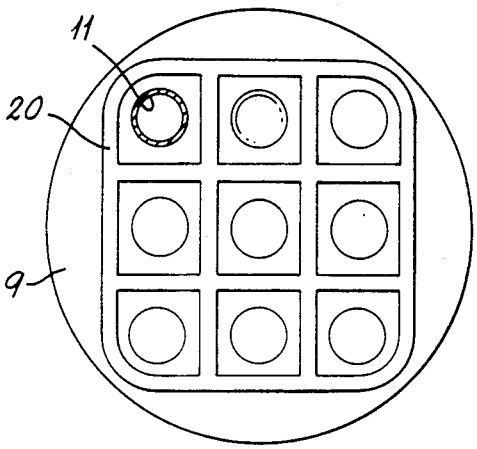
FIG. 3 is an elevation of one of the insulating end plates, taken in an axial direction and from within the shell.

The side wall 6 and cylindrical end plates 7 of the structure of the shell 2 are of steel, and are respectively insulated from the interior of the shell by an insulating cylindrical inner sleeve 8, insulating circular end plates 9, and insulating sleeves 11. Brass collars 10 ensure good contact between tubes 1 and end plates 7, and the tubes, end plates and side wall 6 are all connected to earth potential at 13. An electrode, located within the shell 2 and indicated generally at 15, is connected to a high voltage supply shown schematically at 16 by way of a spring-loaded contact 17 with an insulated terminal 18 mounted in side wall 6. Electrode 15 comprises two similar grid-like end frames 19, which are located in corresponding grid-like recesses 20 (FIG. 3) formed in end plates 9. The tubes 1 pass with clearance through the nine voids 21 of each frame 19. Soldered to the two frames 19 and supported between them are firstly an outer tubular metal gauze 22, which surrounds the entire nest of tubes 1 and has the same section, taken in a plane at right-angles to axis 3, as the end frames 19 themselves.

It is possible that an electrode, simply as so far described, could generate EHD effects capable of effecting some improvement in the rate of heat transfer, through the walls of tubes 1, between fluid passing through the interior of those tubes and the operating fluid which passes through shell 2 between inlets 4 and outlets 5. However there will be an obvious lack of symmetry between the disposition of such an electrode and all of the nine tubes except the central one. The present invention is based upon appreciating that uniformity of the field generated around each tube is important for efficient operation, that such uniformity of field is promoted by generating as uniform as possible a field of the same strength about each electrode, and that this can be achieved by means of a mechanically-simply construction. According to the invention the cross-members 25 of end frames 19 also support rods 26, located so that they tend to promote the electric field on those sides of the individual tubes 1 that are more remote from the outer tubular gauze 22. This promotion tends to improve the uniformity of the field generated by the electrode around each of the tubes. Further improvement could be effected by supporting similar rods between the uprights 27 of the frames 19 or alternatively, as shown, by supporting flat gauze sheets 28 between these uprights. There could be theoretical advantages in replacing the rods 26 with similar flat sheets of gauze supported by cross members 25, as indicated in outline at 29, but there would be obvious practical constructional difficulties associated with the intersection of sheets 28 and 29 within the electrode.

Figure 4:
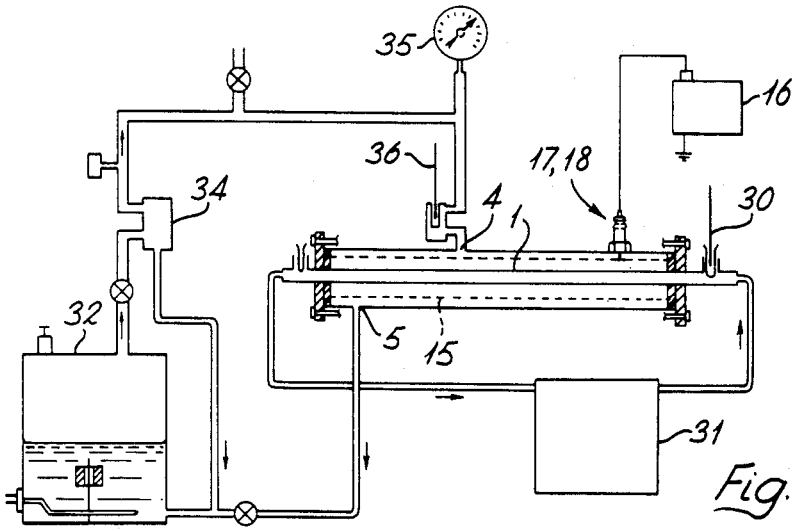
FIG. 4 is a schematic representation of such apparatus as arranged for testing when used as a condenser.

In the diagrammatic representation of FIG. 4, only one of the tubes 1 of the total pass is shown, connected by way of temperature sensors 30 in circuit with a water flow and temperature control 31. Outlet 5 is connected by way of boiler unit 32, liquid trap 34, pressure gauge 35 and thermometer 36 with inlet 4. The liquid circulated by this route must of course be of dielectric character if a useful EHD effect is to be achieved, and typically in modern heat transfer apparatus will be a fluorocarbon, for instance Freon 12 or 114. Tests have suggested that EHD effects, generated by such an electrode when charged to a potential of between, say, 15 and 25 kV in association with suitable other operating parameters, can enhance heat transfer co-efficients between the Freon in shell 2 and the walls of the tubes 1 by a factor of up to 2½.

What is claimed is:

1. A heat exchanger comprising:

a shell-type casing;

a plurality of parallel tubes arranged within and passing through said casing and separated from each other by first clearances, whereby heat exchange may take place through the walls of said tubes between a first fluid medium within said tubes and a second medium outside them but within said casing, said tubes being arranged so that, when viewed in transverse section, they lie at the vertices or intersections of a grid-like regular pattern;

means to enhance the rate of said heat exchange by electrohydrodynamic effect, said means comprising an electrode located within said casing but insulated from both said casing and said tubes and capable of being excitd to high voltage, said electrode comprising:

a first sheet-form member forming a sheath around said plurality of tubes throughout their length;

a plurality of parallel second sheet-form members, separated from each other by second clearances and running lengthwise of said plurality of tubes through said first clearances between said tubes, and parallel third members also running lengthwise of said plurality of tubes, said third members being disposed in the space common to said first and second clearances, said first, said second and third electrode members being electrically connected to each other.

2. A heat exchanger according to claim 1 in which said first member of said electrode is of mesh or other open-work form.

3. A heat exchanger according to claim 1 in which said second members include at least one sheet-form member of mesh or other open-work form.

4. A heat exchanger according to claim 1 in which said third members include rods.

5. A heat exchanger comprising:

a shell-type casing;

a plurality of spaced-apart tubes arranged within and passing through said casing, whereby heat exchange may take place through the walls of said tubes between a first fluid medium within said tubes and a second medium outside them but within said casing;

and means to enhance the rate of said heat exchange by electrohydrodynamic effect, said means comprising an electrode located within said casing but insulated from both said casing and said tubes and capable of being excited to high voltage, said electrode comprising a substantially sheet-form first member which encompasses said tubes and second members running lengthwise through said tubes and to which said first part is electrically connected;

in which said electrode comprises two opposite end frames, between which said end frames both said first and said second members are supported; in which said end frames each comprise an outer boundary, in which crossmembers arranged in grid-like formation span each said outer boundary, in which said first member of said electrode is attached to said outer boundary, in which the ends of said second members are supported on said cross-members of said gird, and in which said tubes pass through the voids of said formation.

* * * * *